United States Patent [19]

Burton

[11] 3,989,404

[45] Nov. 2, 1976

[54] DIRT COMPACTING AND ASPHALT COMPACTING ROLLER UNIT

[76] Inventor: Carl Burton, 1966 S. University Blvd., Denver, Colo. 80210

[22] Filed: July 28, 1975

[21] Appl. No.: 599,895

[52] U.S. Cl. ..... 404/128; 404/124; 404/127

[51] Int. Cl.[2] ..... E01C 19/00

[58] Field of Search ..... 404/121, 122, 124, 127, 404/128, 129; 37/DIG. 15

[56] References Cited

UNITED STATES PATENTS

| | | | |
|---|---|---|---|
| 895,230 | 8/1908 | Beier | 404/121 |
| 2,830,511 | 4/1958 | Wills et al. | 404/128 |
| 3,873,228 | 3/1975 | Dunham | 404/128 |
| 3,891,342 | 6/1975 | Roe | 404/127 |

*Primary Examiner*—Henry S. Jaudon
*Attorney, Agent, or Firm*—Thomas C. Naber

[57] ABSTRACT

A dirt compacting and asphalt compacting roller unit of sufficient weight for utilization in compacting fill dirt introduced into a ditch to fill the ditch, and for utilization in compacting hot asphalt subsequently applied over the previously compacted fill dirt. The roller unit comprises a smooth-surface circumference drum shape roller with concentrically positioned shaft protruding laterally on each side. The roller has two or more detachable dirt compacting plates having multiple exteriorly projecting protrusions which, when the plates are attached to the roller, become the exterior circumference of the roller and act to compact fill dirt when the roller with plates attached is repeatedly rolled over fill dirt within a ditch. When the plates are detached, the smooth-surface circumference of the roller acts to compact hot asphalt when the roller's smooth-surface circumference is repeatedly rolled over hot asphalt subsequently applied over the previously compacted fill dirt. The roller unit additionally comprises an open cube-shape housing frame holding the roller at each side of the roller by securement to the roller's protruding concentric shaft in a manner to permit the roller to rotate. The frame has attachment means attachable to a controllably moveable loading bucket of a self-propelled loader vehicle or optionally attachable to an extension frame means attachable to the loading bucket. The housing frame also houses a tank for water and a water transmission line therefrom to selectively permit the flow of water over the roller for cooling. The housing frame additionally houses one or more scraper brushes and one or more scraper blades, each positioned to be selectively pressured against the roller to remove unwanted matter adhering to the smooth-surface circumference of the roller when the detachable dirt compacting plates are removed and the roller is rotated.

3 Claims, 4 Drawing Figures

DIRT COMPACTING AND ASPHALT COMPACTING ROLLER UNIT

BACKGROUND OF THE INVENTION

In construction work, road repair, and similar duties, it is often necessary to remove a portion of earth, resulting in the formation of a ditch. Upon completion of work involved, it is generally necessary to fill the ditch. To properly fill this ditch so that it maintains adequate density and does not subsequently cave in, dirt, known as fill dirt, is introduced into the ditch and compacted therein to accomplish a soil density essentially equal to the origional undisturbed state. In many instances an asphalt covering over the packed dirt is desired in order to provide a surface covering consistent or integral with the surface adjoining the filled ditch.

Current methods utilized in filling ditches require the use of a loader vehicle whose loading bucket returns fill dirt to the ditch. However, the loader vehicle has no capabilities to compact the fill dirt or to compact the hot asphalt subsequently applied over the compacted dirt. To properly repack a ditch, separate equipment, an air compressor or a gasoline driven compactor, must be utilized. This machinery requires two operators to accomplish the task.

The invention disclosed herein permits usage of a single piece of machinery, a loader vehicle, along with a single operator to accomplish the proper filling and asphalt covering of a ditch. The dirt compacting and asphalt compacting roller unit disclosed herein is conveniently attached to the loading bucket of the loader vehicle, and permits both dirt compacting when detachable dirt compacting plates are attached as well as hot asphalt compacting when the plates are removed.

SUMMARY OF THE INVENTION

The subject of this invention is a dirt compacting and asphalt compacting roller unit of sufficient weight for utilization in compacting fill dirt introduced into a ditch to fill the ditch, and for utilization in compacting hot asphalt subsequently applied over the previously compacted fill dirt. The roller unit comprises a smooth-surface circumference drum shape roller with concentrically positioned shaft protruding laterally on each side. The roller has two or more detachable dirt compacting plates having attachment means and having multiple exteriorly projecting protrusions which, when the plates are attached to the roller, become the exterior circumference of the roller and act to compact fill dirt when the roller with plates attached is repeatedly rolled over fill dirt introduced into a ditch. When the plates are removed, the smooth-surface circumference of the roller acts to compact hot asphalt when the roller's smooth-surface circumference is repeatedly rolled over hot asphalt subsequently applied over the previously compacted fill dirt. The roller unit additionally comprises an open cube-shape housing frame holding the roller at each side of the roller by securement to the roller's protruding concentric shaft in a manner to permit the roller to rotate. The frame has attachment means attachable to a controllably moveable loading bucket of a self-propelled loader vehicle or optionally attachable to an extension frame means which is attachable to the loading bucket. The housing frame also houses a tank for water and a water transmission line therefrom to selectively permit the flow of water over the roller for cooling. The housing frame additionally houses one or more scraper brushes and one or more scraper blades, each positioned to be selectively pressured against the roller to remove unwanted matter adhering to the smooth-surface circumference of the roller when the detachable dirt compacting plates are removed and the roller is rotated.

In a preferred embodiment, the roller can be filled or partialy filled with water to increase the roller unit's weight. Further, the exteriorly projecting protrusions of the dirt compacting plates are disc shape, and the plates are three in number. The housing frame and extension frame means are preferably constructed of one-half inch thick angle iron. The dirt compacting plates and smooth-surface circumference of the roller are preferably constructed of one-half inch thick plate steel.

DRAWINGS OF A PRFERRED EMBODIMENT

DETAILED DESCRIPTION OF THE INVENTION

Figure 1:
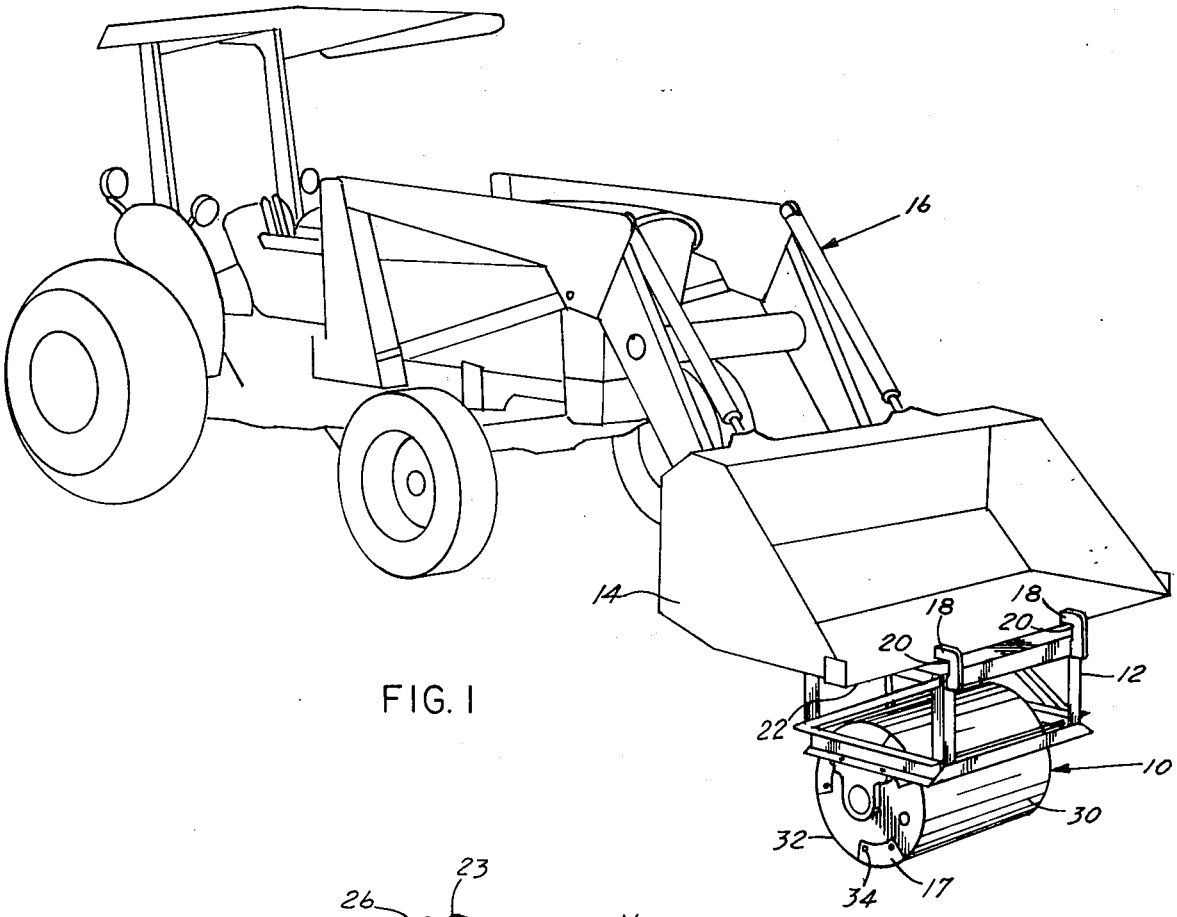
FIG. 1 is a perspective view of a dirt compacting and asphalt compacting roller unit, with dirt compacting plates removed, in place on a loading bucket of a self-propelled loader vehicle.

FIG. 1 shows a roller unit 10 having a housing frame 12 attached to a loading bucket 14 of a loader vehicle 16. Each of two upward-and-rearward projecting forward brackets 18 on the forward top corners of the housing frame 12 are shaped to form respective notches 20 which accept the lower leading edge 22 of the loading bucket 14. The front of the roller unit 10 is firmly secured to the front of the loading bucket 14 when the lower leading edge 22 of the loading bucket 14 is inserted within the two forward notches 20 to hold the forward portion of the housing frame 12. Preferred width of the roller is 22 inches.

The smooth-surface circumference 30 of the roller 32 is exposed in FIG. 1. Threaded openings 34 within receiving brackets 17 on the side of the roller 32 have identical threaded openings in receiving brackets not shown on the opposite side not shown of the roller 32 to secure by means of threaded bolts the dirt compacting plates 36 shown in FIG. 2.

Figure 2:
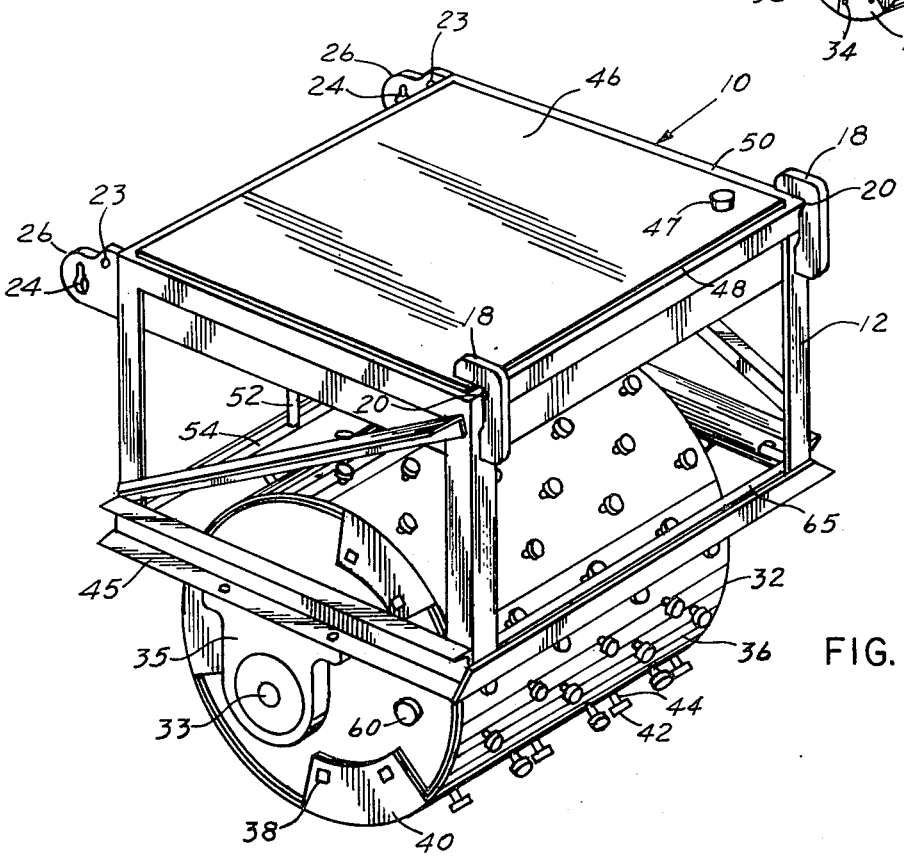
FIG. 2 is a front perspective view of the roller unit with dirt compacting plates attached.

FIG. 2 is a perspective view of the roller unit 10 with detachable dirt compacting plates 36 attached. In the preferred embodiment three plates are utilized, but two or more plates can be used. The plates 36 are attached to the receiving brackets 17 of the roller 32 by means of two threaded bolts 38 which screw through two respective openings in a holding bracket 40 of each plate 36 whose bracket openings are aligned with those threaded openings 34 in the receiving brackets 17. The dirt compacting plates 36 have multiple exteriorly projecting protrusions 42 which are disc shape and atop repective supporting shafts 44. The protrusions 42 are situated in a manner on the dirt compacting plates 36 so that any four protrusions viewed from a point concentric to each of said four protrusions yields the four corners of a diamond shape. When the plates 36 are attached to the roller 32, these protrusions 42 become the circumference of the roller. When the roller 32 with dirt compacting plates attached is repeatedly rolled over fill dirt introduced into a ditch to be filled, the dirt becomes compacted to prevent subsequent cave in or settling of the filled ditch.

Figure 3:
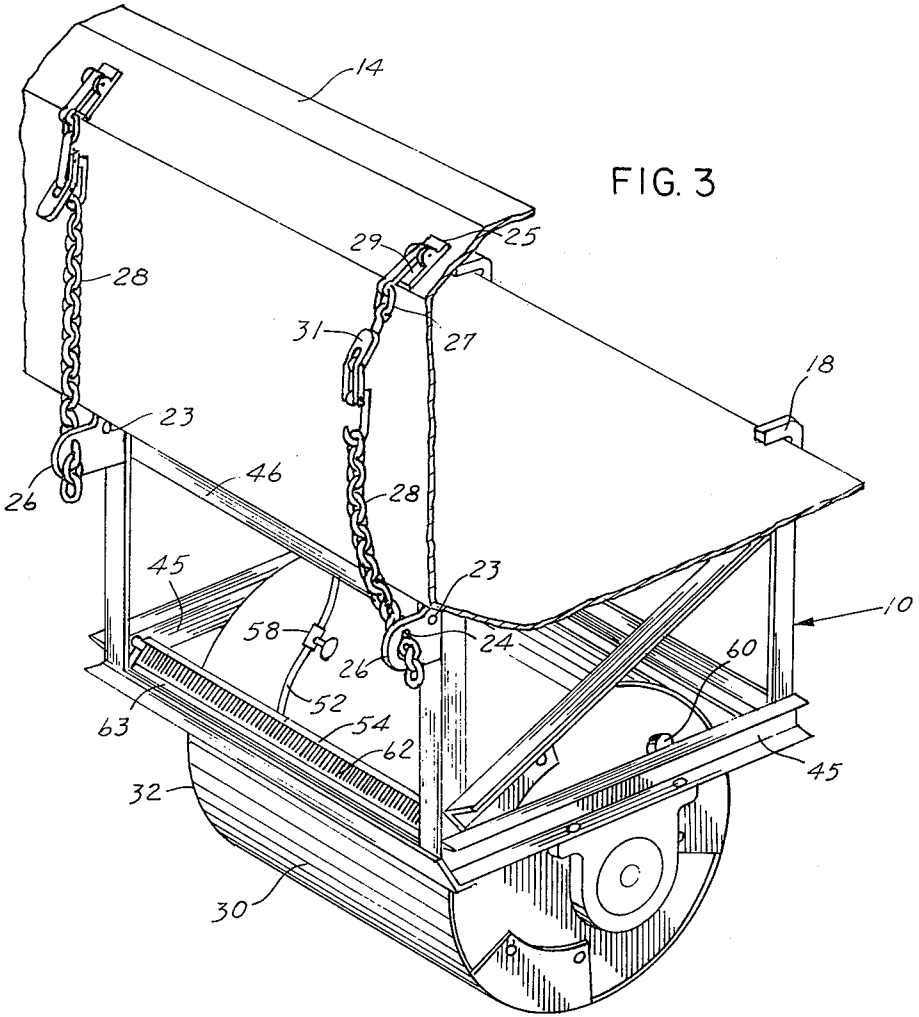
FIG. 3 is a rear perspective view of a loading bucket and illustrates the rear connecting means securing the roller unit to the loading bucket.

Key-shape openings 24 within rearward projecting rear brackets 26 on the rear top corners of the housing frame 12 accept respectively one end of one of two respective removable iron chains whose other ends are secured respectively to respective pivotable iron chains located atop the rear of the loading bucket 14. The chains are held in the narrow portion of the respective key-shape openings 24 and can be removed by being moved to the circular portion of the respective key-shape openings 24 and passed therefrom. Clarity of securement is shown in FIG. 3.

A concentrically positioned iron shaft 33 protrudes laterally on each side of the roller 32, with the lateral protrusions entirely cradled within two pillow-block bearing housings 35, one on each side of the roller 32, to permit rotation of the shaft 33 within the bearing housings 35. The bearing housings 35 are bolted to parallel lower support members 45 of the housing frame 12 to thereby permit the roller 32 to rotate while being held by parallel lower support members 45 of the housing frame 12.

A tank 46, preferably made of galvanized steel, for water is mounted within the top portion of the housing frame 12 by means of spot welding a flange 48 which extends laterally from the entire top of the tank 46 to permit gravitational flow of water into a spreading tube 54 mounted to parallel support members 45 of the housing frame 12. Clarity is shown in FIG. 3.

Capacity of the tank 46 in the preferred embodiment is eight gallons, with water being introduced into the tank through a plug-stoppered opening 47. The plug for the opening 47 is preferably made of iron and has a gasket covering to produce a seal.

An iron scraper blade 65 is mounted to parallel support members 45 of the housing frame 12. The mounting is spring loaded to permit manual selected placement of the blade 65 against or away from the smooth-surface circumference 30 of the roller 32. When placed against the smooth-surface circumference 30, the blade 65 removes unwanted matter adhering to the smooth-surface circumference 30 as the roller 32 rotates.

FIG. 3 clarifies the rear attachment means securing the roller unit 10 to the loading bucket 14. Chains 28 held in key-shape openings 24 of parallel rearward projecting rear brackets 26 extend to respective chains 27 mounted on iron pivoting arms 29 secured by cotter keys to iron base brackets 25 welded atop the loading bucket 14. Each chain 27 has at its respective end a connecting lever 31 known in the art as a boomer which accepts a respective link of the adjoining chain 28 from the roller unit 10. The top of a relaxed connecting lever 31, when moved in a direction away from its pivoting bracket 29 while hooked to a link of a meeting chain 28 from the roller unit 10, draws the meeting chains 27, 28 together to secure the rear of the roller unit 10 to the rear of the loading bucket 14. In FIG. 3, the lever is in its relaxed configuration on the right, and in the secured configuration on the left.

The spreading tube 54, preferably made of copper, is positioned to permit multiple openings in the spreading tube 54 to spread water around straw or hemp bristles of a scraper brush 62 also mounted to each of two parallel support members 45 of the housing frame 12 for cooling of the roller 32 as desired.

The water transmission line 52 is preferably of a pliable material such as polyethylene so that the water flow can be selectively permitted to flow by means of a clamp 58 along the transmission line 52 which pinches closed the line when tightened on the line. Inherent elasticity of the material of the transmission line 52 permits its removable securement to a protruding nipple opening of the tank 46 and a like protruding nipple opening of the spreading tube 54. A plug closed opening 60 permits introduction of water into the interior of the roller 32 upon removal of the plug, with the water so introduced utilized to increase the weight of the roller 32. The plug for the opening 60 is preferably the same material and size as the plug for the water tank's opening 47. The roller unit 10 should have a total weight of at least 1000 pounds to provide adequate compacting capabilities.

An iron scraper blade 63 extending forward of the scraper brush 62 is included within the scraper brush's mounting to each of the parallel support members 45. The mounting is spring loaded to permit manually selected simultaneous placement of the brush 62 and blade 63 against or away from the smooth-surface circumference 30 of the roller 32. When placed against the smooth-surface circumference 30, the brush 62 and blade 63 remove unwanted matter adhering to the smooth-surface circumference 30 as the roller 32 rotates.

Figure 4:
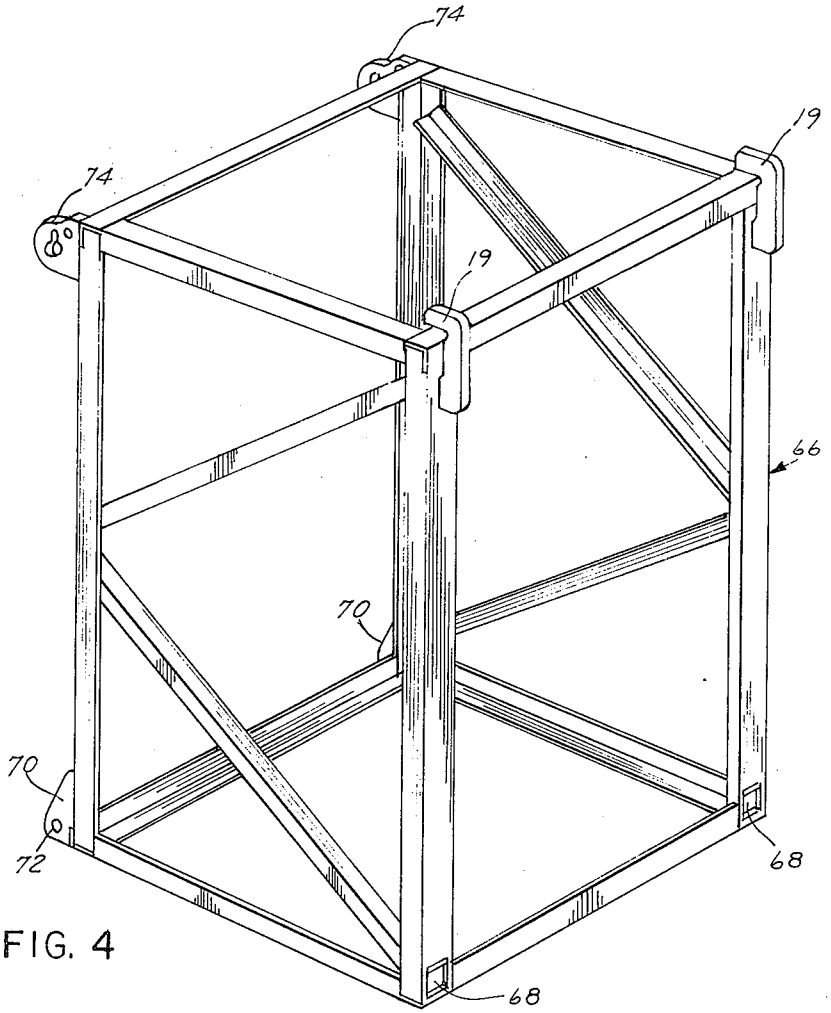
FIG. 4 is a front perspective view of an extension frame means.

FIG. 4 shows an extension frame means 66 having parallel compartments 68 in the front lower corners which accept the upward-and-rearward projecting forward brackets 18 on the forward top corners of the housing frame 12 as shown in FIGS. 1 and 2. At the rear lower corners of the extension frame means 66 are two parallel rearward projecting brackets 70, each having a circular opening 72 therein. The roller unit 10 is secured to the extension frame means 66 by placing the forward brackets 18 of the roller unit 10 as shown in FIGS. 1 and 2 into the compartments 68 of the extension frame means 66 and further secured by aligning each circular opening 72 of the rearward projecting brackets 70 with each corresponding circular opening 23 of each rearward projecting rear bracket 26 of the roller unit 10 as shown in FIGS. 1 and 2 and passing a threaded bolt through each set of resulting adjacent openings 72, 23 and securing the bolt with a compatible threaded nut.

Each of the two upward-and rearward projecting forward brackets 19 on the forward top corners of the extension frame means 66 as well as the rear brackets 74 are identical respectively to the forward brackets 18 and rearward projecting rear brackets 26 of the housing frame 12 to permit identical attachment to the loading bucket 14 of a loader vehicle or to an identical second extension frame means which can be likewise attached to a loading bucket. The extensiion frame means 66 permits the roller 32 of the roller unit 10 to reach the ascending bottom of the ditch being filled. Multiple extension frame means of varying lengths can be attached to each other in like manner so that the roller unit 10 can reach varying depths. Preferably, the extension frame means 66 is of a 2 foot or 5 foot length.

Accomplishment of proper filling and asphalt covering of a ditch involves, for a beginning, partially filling the ditch with fill dirt. The loader vehicle with the attached roller unit disclosed herein with dirt compacting plates attached straddles the ditch and moves forward and backward repeatedly with the roller of the roller unit rolling within the partially filled ditch to cause compacting of the fill dirt. The extension frame means can be used depending on the depth of the ditch to assure proper contact of the roller with the fill dirt. As the fill dirt becomes compacted, additional fill dirt is introduced and the compacting procedure is repeated until the compacted fill dirt completely fills the ditch. Hot asphalt is thereafter applied over the compacted fill dirt. The loader vehicle with the attached roller unit with dirt compacting plates removed straddles the hot asphalt and moves forward and backward repeatedly with the smooth-surface circumference of the roller rolling over the hot asphalt to cause compacting of the asphalt. The number of repeated forward and backward movements required in compacting the dirt and compacting the hot asphalt can readily be determined by an operator skilled in the art.

Manufacture of the roller unit and extension frame means can be performed by those skilled in the art of fabricating, forming, and assembling the materials through utilization of appropriate equipment likewise known in the art.

I claim:

1. A dirt compacting and asphalt compacting roller unit of sufficient weight for utilization in compacting fill dirt introduced into a ditch to fill the ditch, and for utilization in compacting hot asphalt subsequently applied over the previously compacted dirt, the roller unit comprising:

a. a smooth-surface circumference drum shape roller with concentrically positioned shaft protruding laterally on each side and rotatably attached at each shaft protrusion to a housing frame, with the roller having three attached detachable plates which are arc-shaped to fit against the smooth-surface circumference of the roller and which each cover one-third of said smooth-surface circumference, and with the plates having multiple exteriorly projecting dirt compacting protrusions; and b. a cube-shape housing frame rotatably holding at each side and from above the roller's laterally protruding shaft in a manner to permit essentially one-half of the roller to be outside the frame, with the frame having front attachment means comprising two spaced notches which accept the leading bottom edge of a controllably movable loading bucket of a self-propelled loader vehicle and rear attachment means comprising two spaced brackets each having a key-shape opening therein to receive and secure a respective chain secured atop the rear of the loading bucket, and with the frame also housing a tank for water and a water transmission line therefrom to manually selectively permit the flow of water from above over the roller along the roller's width, and with the frame additionally housing a scraper brush and blade assembly and a scraper blade assembly, each assembly manually spring pressurable against the roller.

2. A dirt compacting and asphalt compacting roller unit as claimed in claim 1 wherein the projecting protrusions of the dirt compacting plates are disc shape and atop respective supporting shafts.

3. A dirt compacting and asphalt compacting roller unit as claimed in claim 1 wherein the housing frame and extension frame means are one-half inch thick angle iron and the dirt compacting plates and smooth-surface circumference of the roller are one-half inch thick plate steel.

* * * * *